US006394728B1

(12) United States Patent
Boss

(10) Patent No.: US 6,394,728 B1
(45) Date of Patent: May 28, 2002

(54) BINDING SHEET MEDIA USING IMAGING MATERIAL

(75) Inventor: Roland Boss, Jalisco (MX)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/320,060

(22) Filed: May 26, 1999

(51) Int. Cl.[7] ..... B42B 5/00
(52) U.S. Cl. ..... 412/1; 412/6; 412/33
(58) Field of Search ..... 412/900–901, 412/902, 33, 37, 36, 8, 6; 270/58.11; 430/124; 118/638; 156/151

(56) References Cited

U.S. PATENT DOCUMENTS

| | | | | |
|---|---|---|---|---|
| 3,793,016 A | | 2/1974 | Eichorn | 96/1 R |
| 3,794,550 A | | 2/1974 | Taillie | 161/147 |
| 4,343,673 A | | 8/1982 | Smith, Jr. et al. | 156/583 |
| 4,398,986 A | | 8/1983 | Smith, Jr. et al. | 156/290 |
| 4,826,475 A | | 5/1989 | Eweryd | 493/10 |
| 5,014,092 A | | 5/1991 | Kubo et al. | 355/324 |
| 5,213,560 A | | 5/1993 | Crowley | 493/231 |
| 5,288,192 A | * | 2/1994 | Ito et al. | 412/900 |
| 5,328,438 A | | 7/1994 | Crowley | 493/187 |
| 5,456,646 A | | 10/1995 | Crowley | 493/187 |
| 5,531,429 A | | 7/1996 | Clark | 270/58.11 |
| 5,582,570 A | | 12/1996 | Crowley | 493/187 |

* cited by examiner

*Primary Examiner*—Willmon Fridie, Jr.

(57) ABSTRACT

Binding sheet media using imaging forming material applied to binding regions on sheets of paper or other print media. In one embodiment of the invention, imaging material is applied to facing sides of the sheets to bind them together. In a second embodiment, the imaging material in the binding region is re-activated as each sheet or a group of sheets as they come out of the printer. In a third embodiment, the imaging material is used to bind the sheets in a booklet along a fold line. In this third embodiment of the invention, imaging material is applied to a binding region along the fold line of each sheet. The sheets are then assembled for binding along the fold line and the imaging material in the binding region is re-activated to bind the sheets into a booklet.

24 Claims, 8 Drawing Sheets

BINDING SHEET MEDIA USING IMAGING MATERIAL

FIELD OF THE INVENTION

The present invention relates to binding together sheets of paper or other print media. More specifically, the invention relates to binding the sheets using the same imaging material, toner, ink and the like, used to print the text or images on the sheets.

BACKGROUND OF THE INVENTION

Currently used methods to bind multiple pages together include stapling, clamping, gluing and sewing. Each of these methods add additional "mixed materials" to the final document.

In the case of print jobs including small amounts of paper or other sheet media, the most common method is stapling. Stapling has the advantage that it is useful for short runs in that elaborate sewing or other assembly equipment is not required. A disadvantage of stapling is that stapling requires one or more relatively complex and expensive stapling mechanisms. Another disadvantage is that stapled papers have poor stacking characteristics. In the case of documents which are produced by the use of laser printers, any additional procedures involve the use of additional equipment, either within the printer or external to the printer. That means that the ability of providing office printers which are capable of providing assembling booklets or other multi-page brochures is limited.

It would be desired to provide a method or apparatus for assembling multiple sheets of paper or other sheet media which does not require any additional material to fix the sheet media. It is desired to avoid items such as staples, glue, or thread, and more particularly it is desired to avoid the cost and handling of such additional materials. It is further desired that a laser printer or similar piece of equipment be provided with an ability to assemble print jobs in bound format, without the requirement that the printing equipment be made substantially more complicated or less economical. It is desired to provide a simplified automatic paper binding device for such a printer.

Another disadvantage of prior art paper binding equipment is the tendency of pages becoming damaged upon separation. In some cases, staples and other binding devices can be carefully removed and then carefully re-inserted. While individuals disassembling and reassembling original copies are often willing to exert more effort in the reassembly than would be required for originally binding the document, it is often the case that individuals will not wish to engage in activities which require precise mechanical skills just to re-bind a document. Therefore, a re-bound document will often have a tattered appearance.

Often a document is produced and assembled as a bound document, only to be unbound for further processing or duplication. In such a case, it is desired to have a binding mechanism which permits the document to be provided in bound form, but which also permits the document to be disassembled for further handling. Thus, if the document is to be stapled, the stapling need occur only after the completion of paper handling, even if the document is initially delivered in a bound form. In the prior art, this was accomplished by either paper clipping the document, and then stapling or attaching a binder to the document, or by initially binding the document on a more permanent basis, such as by stapling, followed by removing the staple, followed by re-binding the document. Needless to say, the binding and unbinding of the document is complicated and disadvantageous.

In producing a document, often pre-processing and post-processing steps are required. In the case of an individual letter, this includes signing and folding the letter, followed by inserting the letter into an envelope, sealing the envelope and applying postage. In the case of mass mailings, it is often not necessary to sign the letter, but the other steps must be performed, such as sorting by address.

Arrangements to provide documents in letter form, along with folding, sealing and franking are referred to as "mailing systems." Mailing systems are used for pre-printed forms, but often individualized documents such as bills require that primary documents to be mailed be individually produced and incorporated into the mailing system.

In some cases, bound stacks of paper are intended to be unbound in use. This is the case with writing pads or tablets in which the sheets are removed at a glue line or perforation. If pre-printed forms are desired in this format, setup costs are significant. Therefore, large print runs are required to economically provide such forms in tablet format. It would be desirable to provide an ability to economically print forms in small runs.

The attachment of multiple larger sheets to form booklets is well-known, and the bookbinding art even has conventional numbers of pages in which smaller sections, called "signatures" or "units," containing 16, 32, or 64 pages, are assembled for purposes of printing and bookbinding. The present invention relates to a technique useful for creating signatures as well as for smaller signatures and for pamphlets.

One problem of binding documents is the fact that the bound document is composed of mixed materials. When the document is to be recycled, the mixed materials either degrade the recyclability of the document or require that recycling facilities be able to separate the mixed materials. Thus, plastic, glue, tape and staples must be addressed as additional materials besides the paper and ink which forms the basis of the document. The use of mixed materials thereby creates an economic cost which either appears in the cost of raw materials and waste. In some cases, these costs are transferred to the user through sanctions commensurate with the economic costs involved in the use of materials which are more difficult to recycle.

As a result, it would be advantageous to provide a document product which, in bound form, consists of the paper and ink that forms the basis for the paper product, and in which the binding process does not add additional types of material to the product. By reducing the mix of materials, recycling is simplified.

In binding of documents, it would be desirable to vary parameters or material properties to allow adjustments in holding force used to adhere the pages together. This would facilitate adjusting the binding of the pages between permanent fixation to light or temporary fixation. Presently this is accomplished by paper clipping the sheets together or by carefully removing and replacing staples.

One of the problems with post-printing processing is that the user must wait until completion of the process. It is therefore desired that a post-printing binding process not consume significantly more time than the printing of the document.

SUMMARY OF THE INVENTION

The present invention is directed to new techniques and devices for printing and binding sheet media using imaging material as the binder and the documents produced using these new techniques. In general, patterns of imaging material are printed in selected binding regions on one or both of the opposing surfaces to bind sheets together. The binding regions typically may be any shape and number adequate to bind the sheets permanently or temporarily, as necessary or desired, and may be printed at the same time the image of the page is printed. The imaging material in the binding regions is re-activated after the page is printed by any combination of exposure to conducted or radiated heat, pressure, electric or magnetic fields chemical, ultrasound or by any other suitable means.

In one embodiment of the invention, imaging material is applied to facing sides of the sheets to bind them together. Unlike conventional methods where a the imaging material is more dense in the binding region on each sheet, in this embodiment of the invention the imaging material can be applied to the same thickness in the binding region and in the print pattern. In this first embodiment, imaging material is applied in a pattern of a desired print image and to a binding region on each sheet. The binding region is aligned with and faces a binding region on an adjacent sheet when the sheets are assembled for binding. The imaging material is activated. Where laser toner is used as the imaging material, the activation process is called fixing or fusing the toner. Then, the sheets are assembled for binding and the imaging material in the binding region re-activated (re-fused if laser toner is used as the imaging material) to bind the sheets.

In a second embodiment, the imaging material in the binding region is reactivated as each sheet or a group of sheets comes out of the printer. This embodiment includes the steps of (1) applying imaging material in a pattern of a desired print image on each sheet, (2) applying imaging material to a binding region on each sheet, (3) activating the imaging material, (4) assembling two or more sheets for binding, (5) re-activating imaging material in the binding region to bind the assembled sheets, (6) assembling at least one additional sheet with the sheets previously bound, (7) re-activating imaging material in the binding region to bind the additional sheet(s), and (8) repeating the steps of assembling and re-activating until all sheets are bound.

In a third embodiment, the imaging material is used to bind the sheets in a booklet along a fold line. In this third embodiment of the invention, imaging material is applied to a binding region along the fold line of each sheet. The sheets are then assembled for binding along the fold line and the imaging material in the binding region is re-activated to bind the sheets into a booklet.

Variation of parameters or material properties of the printing material can be used to allow adjustments in holding force used to adhere the pages together. Therefore, it is possible to vary the binding of the pages between strong or permanent fixation to light or temporary fixation. The ability to vary the binding force allows a document to be optimally temporarily assembled and then later disassembled without significantly damaging the sheets.

Image, as used herein, means a visually perceptible text or graphic marking and photographic imaging, including both color and monochromatic presentations. "Imaging material" means printing material deposited on a sheet of paper or other sheet media and includes laser toner, printing ink, or any other type of toner or material which is used for producing an image on a document. It is, of course, possible that a variation in the material be established in suitable circumstances so that the pigmentation of the imaging material is less noticeable. Such imaging material is deposited upon "sheet media" which may include paper or other materials which are used for receiving a printed image. Typically, printed documents include at least sheet media and printing material.

DETAILED DESCRIPTION OF THE INVENTION

Figure 1:
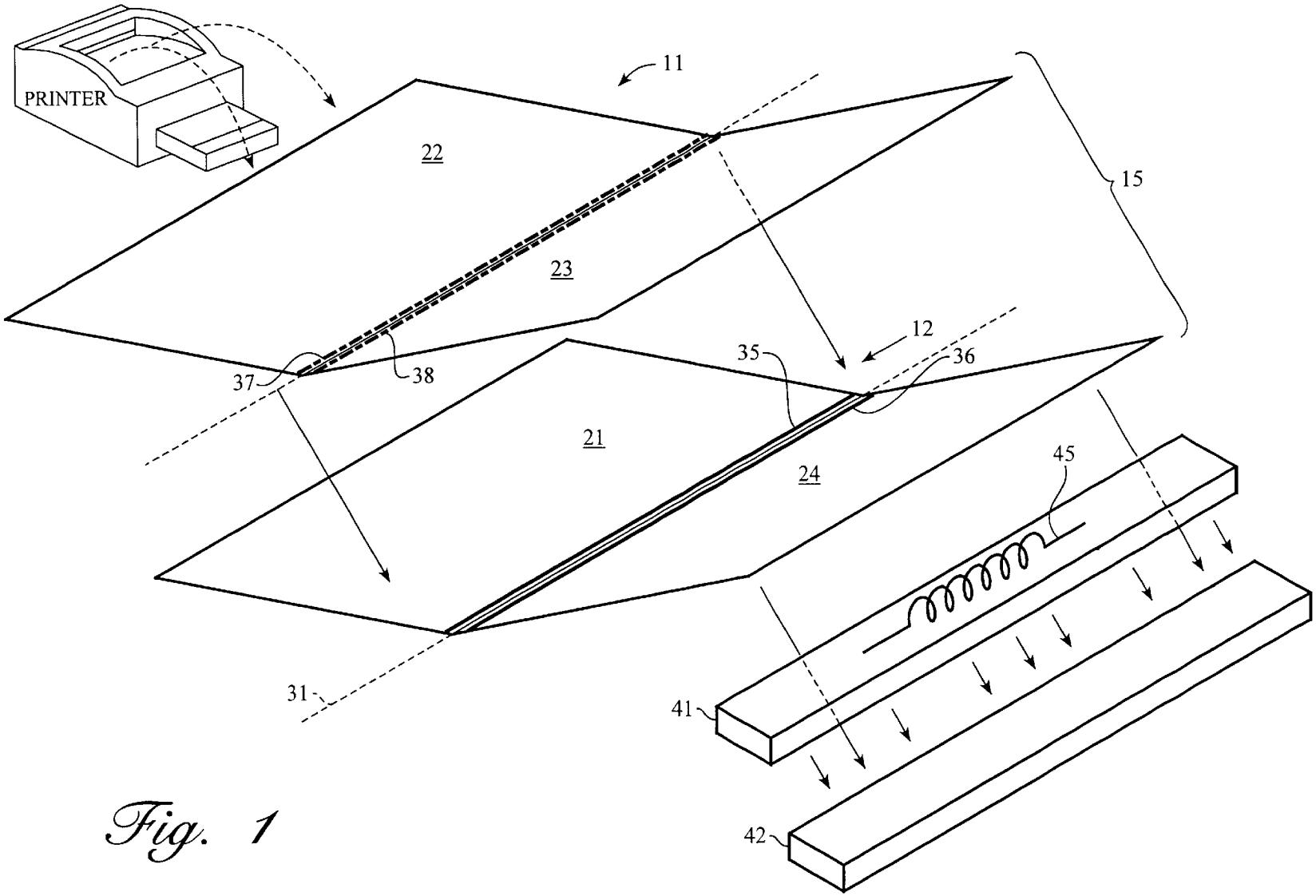
FIG. 1 shows the use of the invention in order to form a booklet bound along a center fold line.

FIG. 1 shows a pair of document sheets 11, 12 which are used to form a printed, bound booklet. The booklet 15, in its bound form, will include four sheets, designated 21–24, for eight pages (including the front and back sides of the sheets 21–24). The four sheets 21–24 are formed as half sheets from the two document sheets 11, 12. The booklet 15 is assembled along center line 31, where the two larger sheets 11, 12 are attached. The figures show the sheets 11, 12 folded. In one preferred embodiment, flat sheets are bound, and after binding, the resulting booklet is folded.

In FIG. 1, the sheets 11, 12 are bound on either side of the center line 31. The sheets 11, 12 are, in the preferred embodiment, printed with a laser printer, wherein laser toner is used as the printing material. In order to bind the sheets 11, 12 together, additional laser toner is applied, as depicted at 35–36, on sheet 12. In addition, lines of toner 37–38 are deposited on the backside of sheet 11, so that when sheets 11 and 12 are assembled to form the booklet, the lines of toner 35, 37 and 36, 38 are aligned with and face one another. The toner along the lines 35–38 is provided as a binder so that the sheets 11, 12 may be attached. Therefore, the toner acts as a bonding material for binding the sheets 11, 12 together. By providing the toner in sufficient quantity, it is possible to secure the sheets 11, 12 to each other.

In the case of computer printing, the toner along lines 35–38 may be generated by a computer program producing the image or by a separate driver program. It is also possible to use a separate program on a host computer to add the additional text.

The securing of the sheets 11, 12 to each other is preferably accomplished by re-activating, that is, re-fusing the toner 35–38. The re-activation may be by the same process as fusing the toner during printing. The toner may be obtained from a common reservoir as the toner used for imagery so that the toner for binding and the toner for printing are from a common source. Alternatively, the toner intended for binding may come from a separate reservoir so that the toner from that source could be formulated to be especially suitable for bonding by re-activating. The present invention, in one embodiment, typically will use a process of "precoating" the imaging material in the regions and areas for binding, and either fusing at the same time the image is fused, or, alternatively, providing a printer with the bonding areas and regions having the fusable material predisposed on the sheet. In this way the sheet can be 1. precoated in binding regions; 2. printed with non fusable technology, such as inkjet; and then 3. sealed, bound or fused in an attached accessory or standalone post processing unit.

Upon completion of the print job, the sheets 11, 12, when they are ready to be bound, are passed between bars 41, 42, which compress the sheets 11, 12 together at the toner lines 35, 37. In order to better fuse the toner along line 35, 37, heat may be applied, as represented by heater 45. The bars 41, 42 and heater 45 thereby perform the function of a fuser station. While a single heater symbol 45 is represented, it is understood that either one or both bars 41, 42 may incorporate heating elements.

The re-activation process performed by bars 41, 42 and heater 45 may be accomplished by reheating the entire portions of sheets 11, 12 or may be selectively applied to the sheets 11, 12 in the region of the lines of toner 35–38 used for binding. This process of applying heat and pressure will result in the printed images on the sheets 11, 12 sticking to the adjacent pages. It is anticipated that, if the heat and pressure is adequately controlled, the amount of sticking at the printed images will be minimal, as compared to the effect of binding along the lines of toner 35–38 This is particularly true if the toner applied along line 35–38 is significantly heavier in quantity and thickness, as compared to the toner used to produce printed images. In addition, since the location of the binding line 31 is known, the heat and particularly the pressure applied to the sheets 11, 12 may be applied primarily along the binding line 31. Selective application of heat and pressure would reduce the effects of unwanted binding along the images which would otherwise result from re-activating the printed image.

For large stacks of paper, it may be necessary to convey heat through the stack. This may be accomplished by direct application of heat. Additionally, a variety of techniques may be used for this, including ultrasound, magnetic energy, radio frequency energy and other forms of electromagnetic energy. It is possible to use toner which re-activates upon application of pressure. The toner used for binding may include magnetic ink or otherwise may have a quality of reacting to electromagnetic, optical or actinic energy (infrared, visible or ultraviolet). The ability to react to energy may be in the form of heat conversion or chemical reaction. The ability to react to energy enhances the ability of re-activating without burning the paper or otherwise damaging the sheets.

It is possible to accomplish selective re-activation in a number of ways. For example, the bars 41, 42 could be completely released when re-activation is not desired (i.e. on the text portion of the page). The bars 41, 42 could have light pressure except where binding is required. It is possible to use a heat source which is selective in its application of heat, either as a result of location along a bar 41, or as a result of switching, for example, of infrared light. It is also possible to use other forms of re-activation stations and it is possible to allow the user to manually apply re-activation pressure subsequent to the completion of the print process, much in the manner that one may manually staple sheets together at the completion of a print job.

Since the location and shape of the lines of toner 35, 37 used for binding is known and is limited to a few different locations, it is possible to apply such toner in a manner which is different from the toner applied to produce the printed image. Therefore, toner supplied along the binding lines may have different physical characteristics, and this would permit such toner to provide better binding characteristics. It is, of course, desirable that such toner be compatible with toner applied to provide the printed image, so that any mixing of toner does not have significant detrimental effects on the quality of the printed image.

In FIG. 1, a line of toner is deposited on both sheets, i.e., line 35 on the front side of sheet 12 and line 37 on the back side of sheet 11. It is possible to accomplish binding of printed media with toner only on one of the sheets, such as by providing toner along line 35 of sheet 12 without applying toner to sheet 11. Since the example shown is of a booklet 15, it is likely that both sides of the print media are provided with a printed image, thereby simplifying the task of applying toner to both sides of the sheets. The ability to re-activate the toner at bars 41, 42 makes it easier to use toner on only one sheet.

Figure 2:
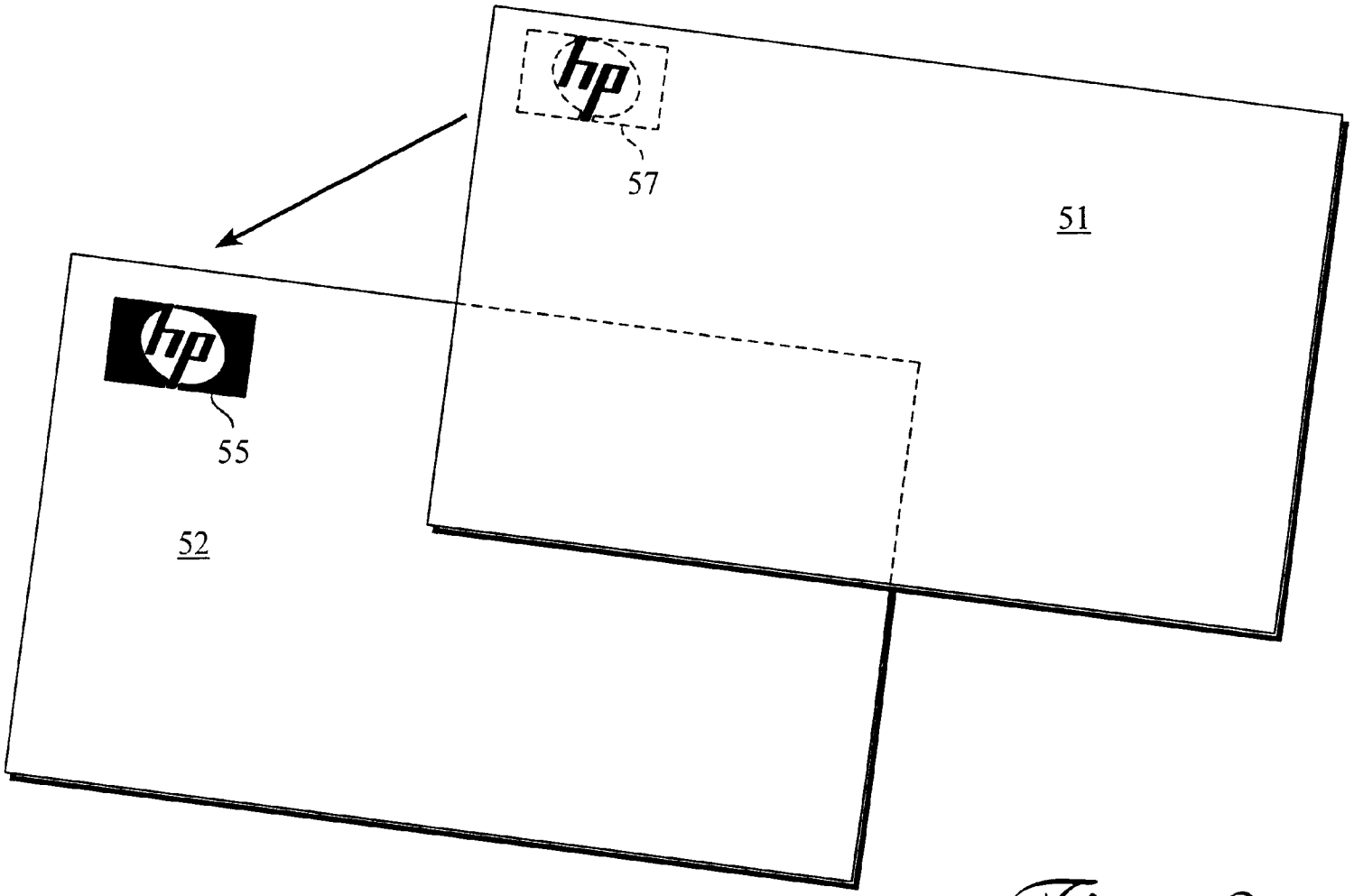
FIG. 2 shows the use of a logo for binding adjacent pages at a corner spot similar to stapling sheets together.

FIG. 2 shows an arrangement in which documents are bound at one corner. In FIG. 2, sheets 51, 52 are provided with a logo 55, 57 on the front and back sides of the sheets 51, 52 as needed. Alternative designs are also useful and the variety of designs covered by the present invention is unlimited, although in a preferred embodiment a small design is optimized for bonding use by rounding corners to spread the binding stresses over a larger area of the bound region. In a yet additional preferred embodiment, the corners of a design are optimized for separation by a pointed aspect to concentrate the stress of separation, making the binding easier to separate at the location on the sheet where desired.

The logo includes a large amount of toner and thereby permits the sheets 51, 52 to be fixed together by re-activating the sheets in the area of the logos 55, 57. The effect is similar to corner stapling, except that the toner in the logo is used as the binding material. The logo or design may be an existing logo or one optimized for effecting binding when the sheets 51, 52 are fixed together.

Figure 3:
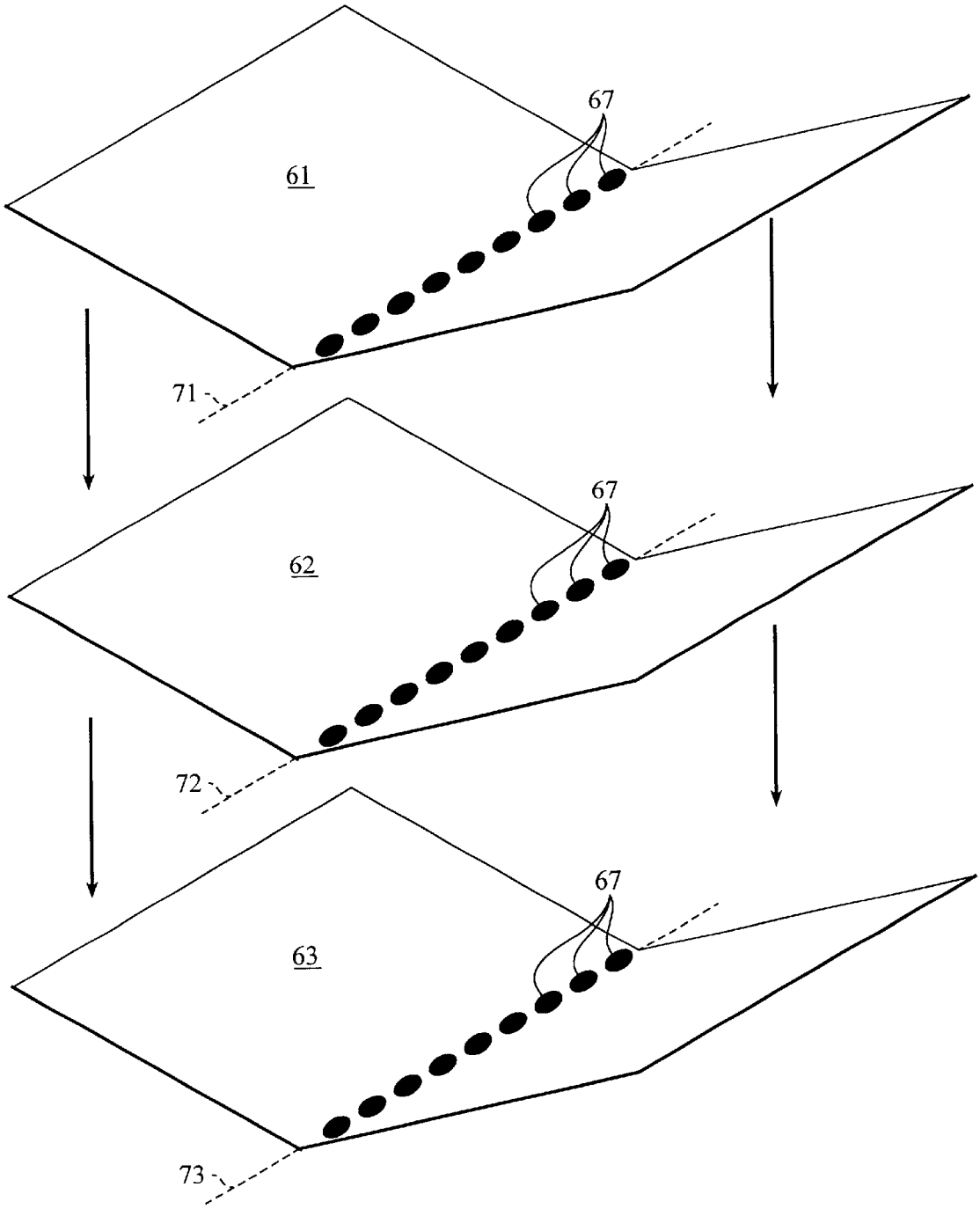
FIG. 3 shows a configuration in which an arrangement of dots is used to establish a region for binding adjacent pages.

FIG. 3 shows a configuration in which a plurality of sheets 61–63 are provided with toner in the form of large dots 67. The dots form binding areas along binding lines 71–73. As can be seen from FIG. 3, it is possible to bind more than two sheets together, provided that heat and pressure is delivered to the toner in order to re-activate the toner.

Figure 4:
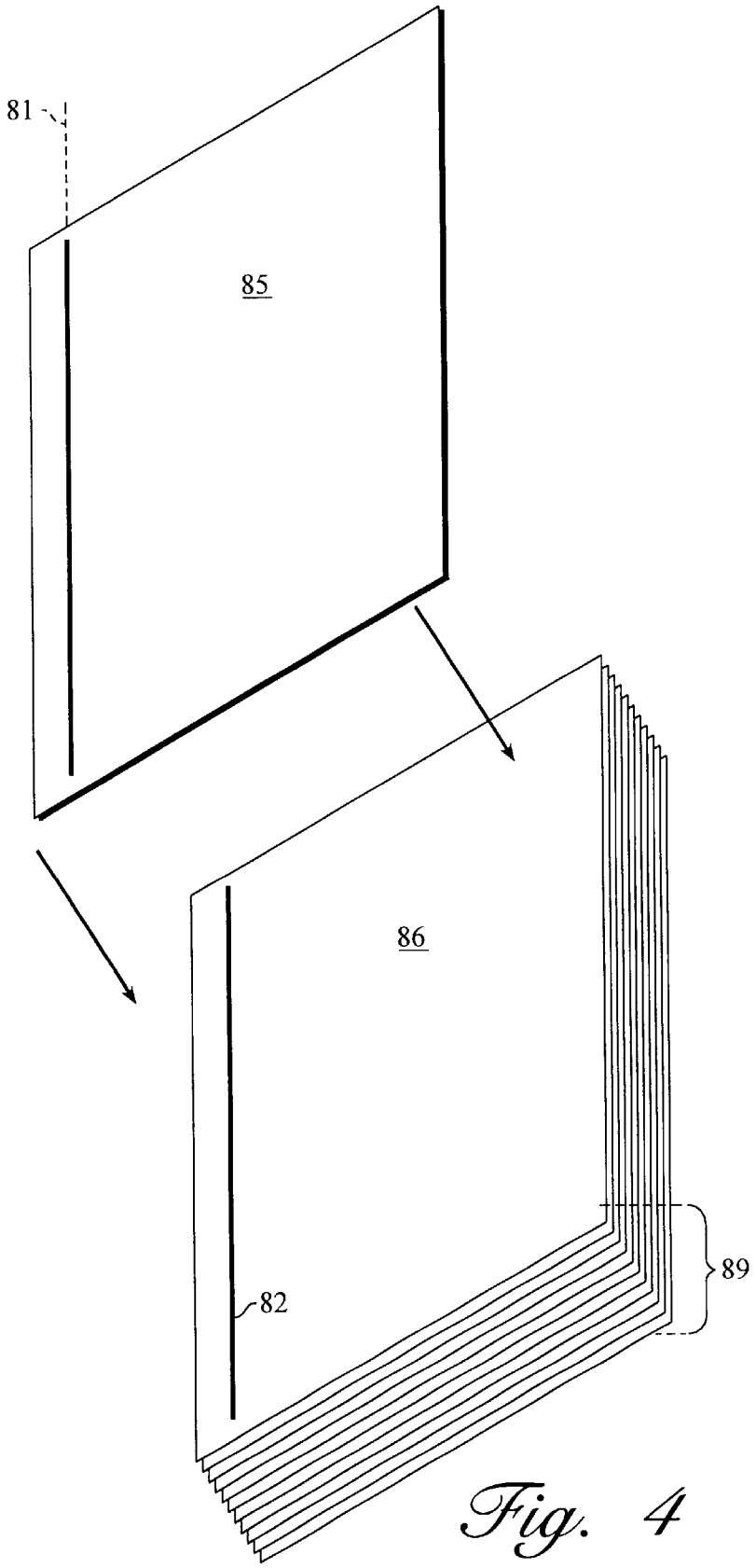
FIG. 4 shows a configuration in which pages are bound along an edge of the pages.

FIG. 4 shows an arrangement in which binding of multiple sheets is accomplished by providing binding lines 81, 82 near an edge of the sheets to be bound. This accomplishes the equivalent of stapling along the edge of the sheets 85, 86 and also provides a substitute for the use of plastic comb binders on small print jobs.

It is also possible to accomplish binding of large stacks using the inventive techniques. As shown in FIG. 4, sheet 85 is to be bound on top of sheet 86. Sheet 86 may be the top sheet of a large stack 89 of sheets, so that sheet 85 can be sent to be bound to the top of the stack 89. In this manner, sequential sheets may be bound to large thicknesses, such as those typically found on telephone directories.

While it is generally conceived that the binding be accomplished in a permanent or semi-permanent fashion, in is possible to lightly bind the sheets, such as sheet 85 to stack 89. In this manner, it is possible to have a tear-off tablet, such as a writing tablet, in which individual pages may be removed from the top of the tablet. The tablet format can be used in order to assemble preprinted forms, such as used for providing notes or medical prescriptions on letterhead. Since it is possible to use laser printing or similar techniques, short run print jobs can economically be bound into tablet form.

The binding of sequential sheets on top of a stack, such as FIG. 4, provides an advantage in that the binding process can be accomplished at a speed which corresponds to the speed at which a printer discharges sheets. This means that the time delay caused by the need to re-activate the toner is minimal. Ideally, the time required for re-activating would be less than the time between the output of sequential sheets, so that the time delay would be no greater than the time which would be required for discharging an additional sheet.

Therefore, by sequentially binding the top sheets on to the stack 89, the total time for accomplishing the binding is significantly reduced. Preferably, the time for binding one sheet is less than the time period between the printing of sequential sheets. This reduces the time delay in delivering the bound print job by performing sequential binding operation during the print operation. Therefore, the total delay is no greater than the print cycle for one page.

Figure 5:
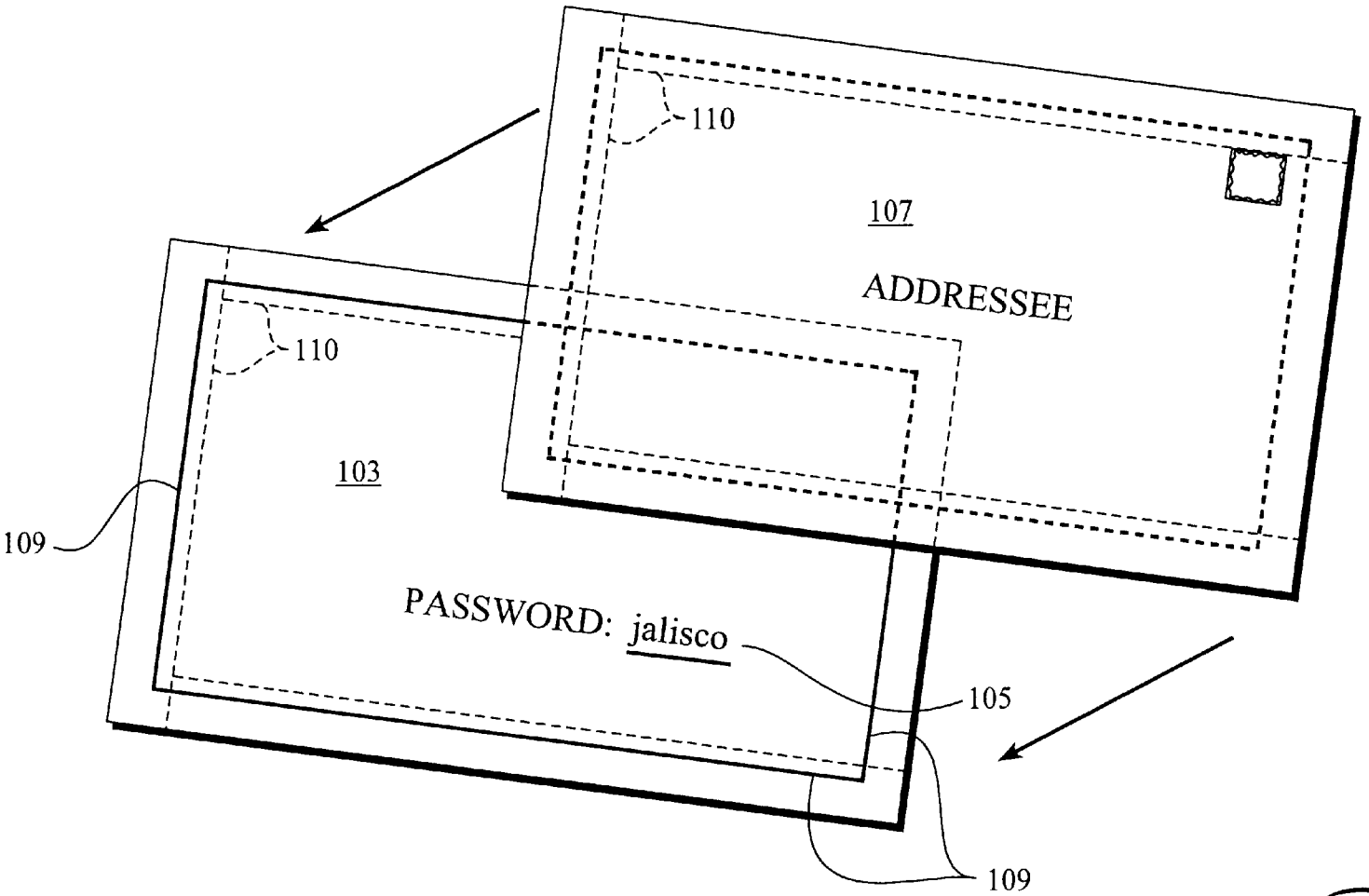
FIG. 5 shows an arrangement to provide a security seal around confidential printed information.

FIG. 5 shows an arrangement in which confidential information is provided in printed form. In the example shown, confidential information is printed on a lower sheet 103, such as the password 'jalisco' 105 depicted. A top sheet 107 then is fused onto the bottom sheet 103 by the use of toner lines 109. Since the process is accomplished at the time of printing, the exposure of the privatized information to unauthorized personnel is minimized. This provides a security seal for the resulting document. This security seal region can be a single circular or oval region, or may be made of a line patterned on each edge of the seal area to form an area essentially surrounded by bonding material, typically in the shape of a rectangle, although other shapes and forms are readily apparent to one of ordinary skill, and are covered by the scope of the appended claims. If the binding of the sheets 103, 107 is made sufficiently strong, the person intended to receive the privatized information is assured that third parties did not open the document prior to the intended party receiving the document. Perforations 110 facilitate opening and disclose casual tampering with the seal at the toner lines 109. These perforations 110 may be part of the unprinted paper stock, with or without the toner bonding patterns in place and fused, or formed as a post processing step by the paper handling equipment.

Figure 6:
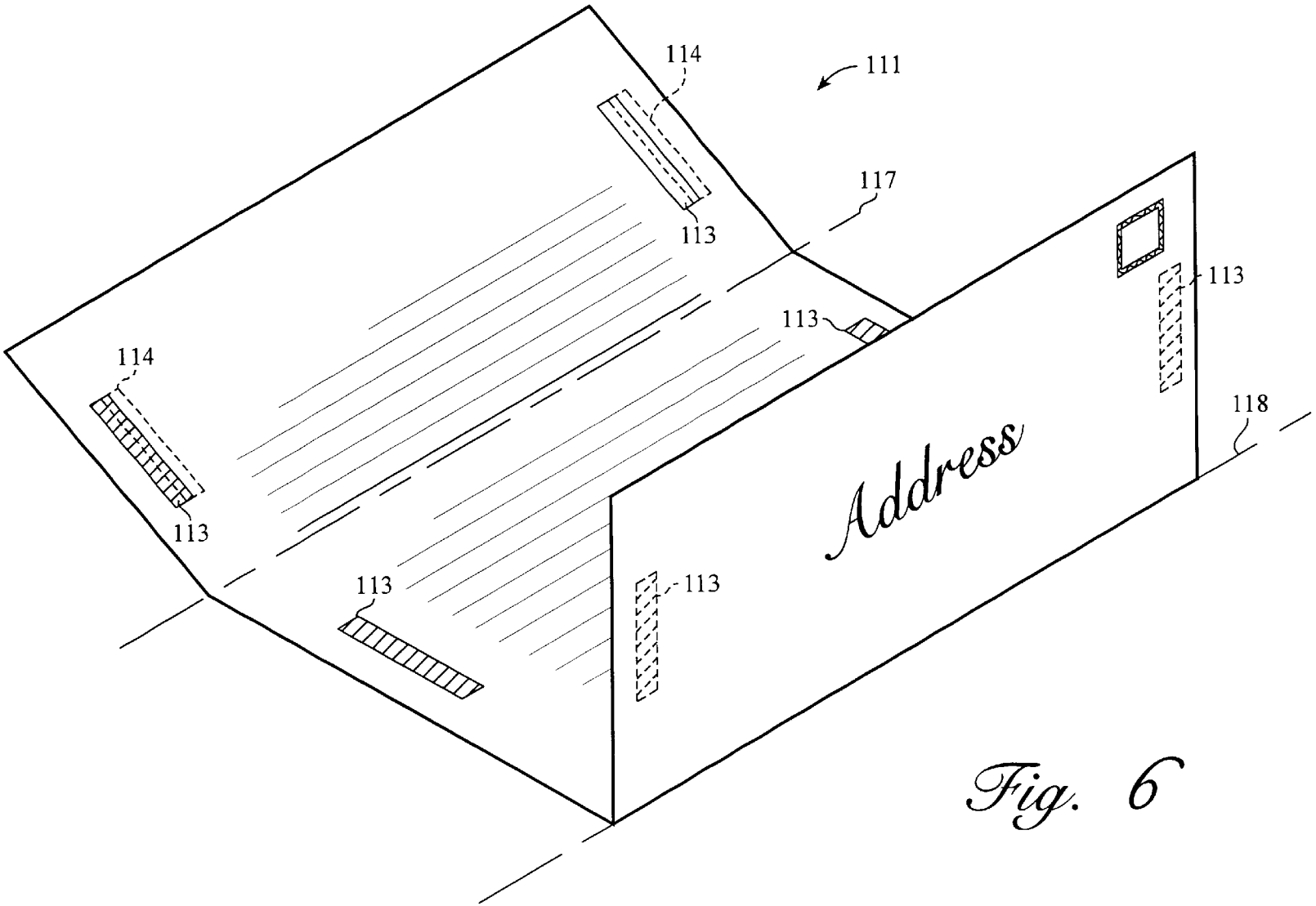
FIG. 6 shows an arrangement where a sheet is folded to form a closed envelope.

FIG. 6 shows the use of the invention to form an enclosed document from a single sheet 111. Areas of toner 113, 114 are deposited as binding material along selected areas of the periphery of the sheet 111. The areas of toner are preferably printed on the front (113) and back (114) sides. The sheet 111 is then folded back against itself in trifold fashion along its center lines 117, 118 and the toner 113 is re-activated. This results in a closed enclosure. This technique can also be used to provide a security seal in the manner described in association with FIG. 5.

Figure 7:
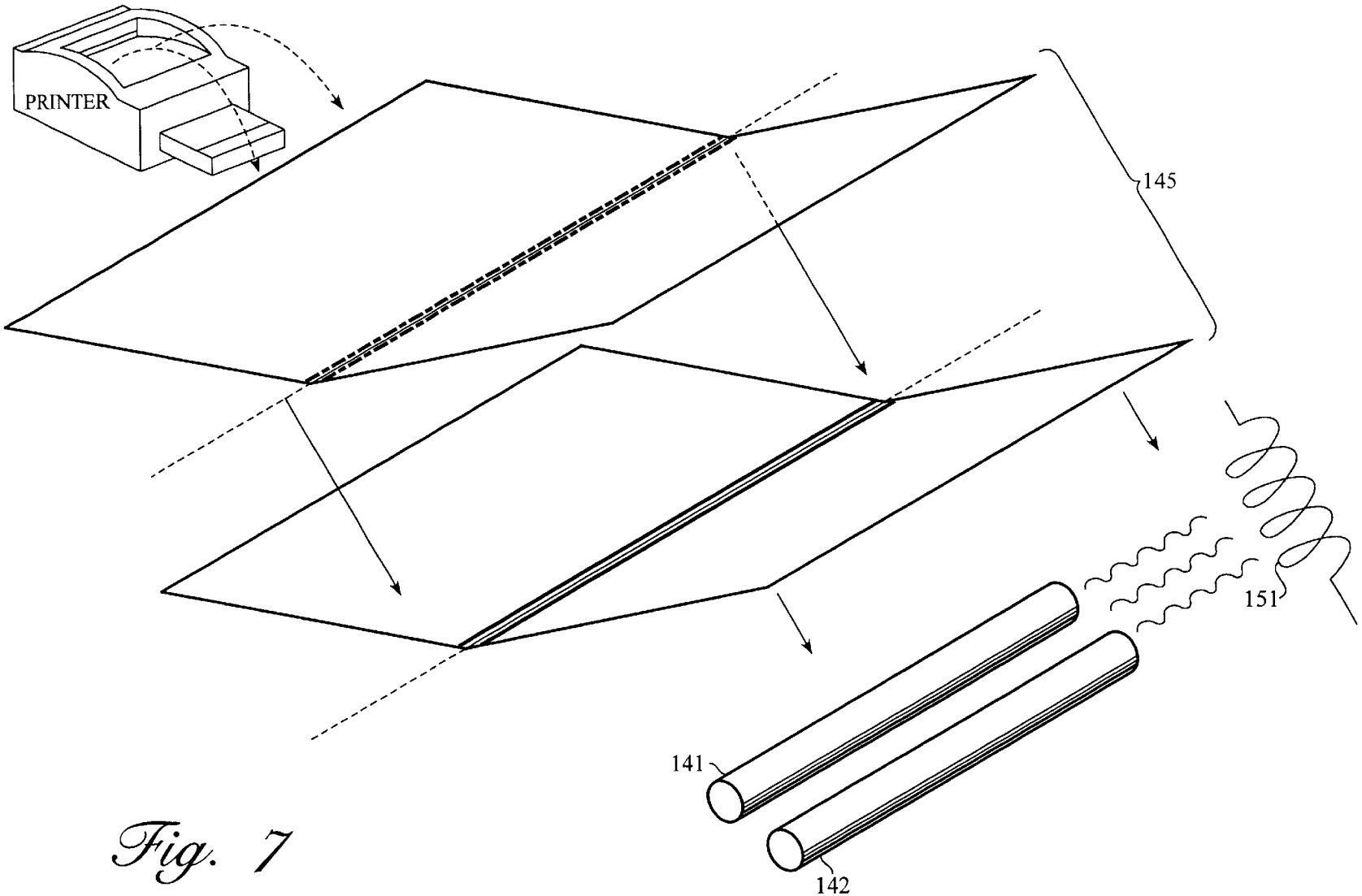
FIG. 7 shows the use of nip rollers to effect re-activation of the imaging material.

FIG. 7 shows the use of nip rollers 141, 142 used to effect re-activation toner deposited on a document 145. A heater, represented at 151, is used to heat the rollers 141, 142. Re-activation can be accomplished in any convenient manner and if a heater 151 is used, that heater 151 may be positioned within one or both of the rollers 141, 142, or may be formed as a narrow strip within one or both of the rollers 141, 142. The heating of a narrow strip allows localized heating and selectively re-activates the toner where binding is desired.

Figure 8:
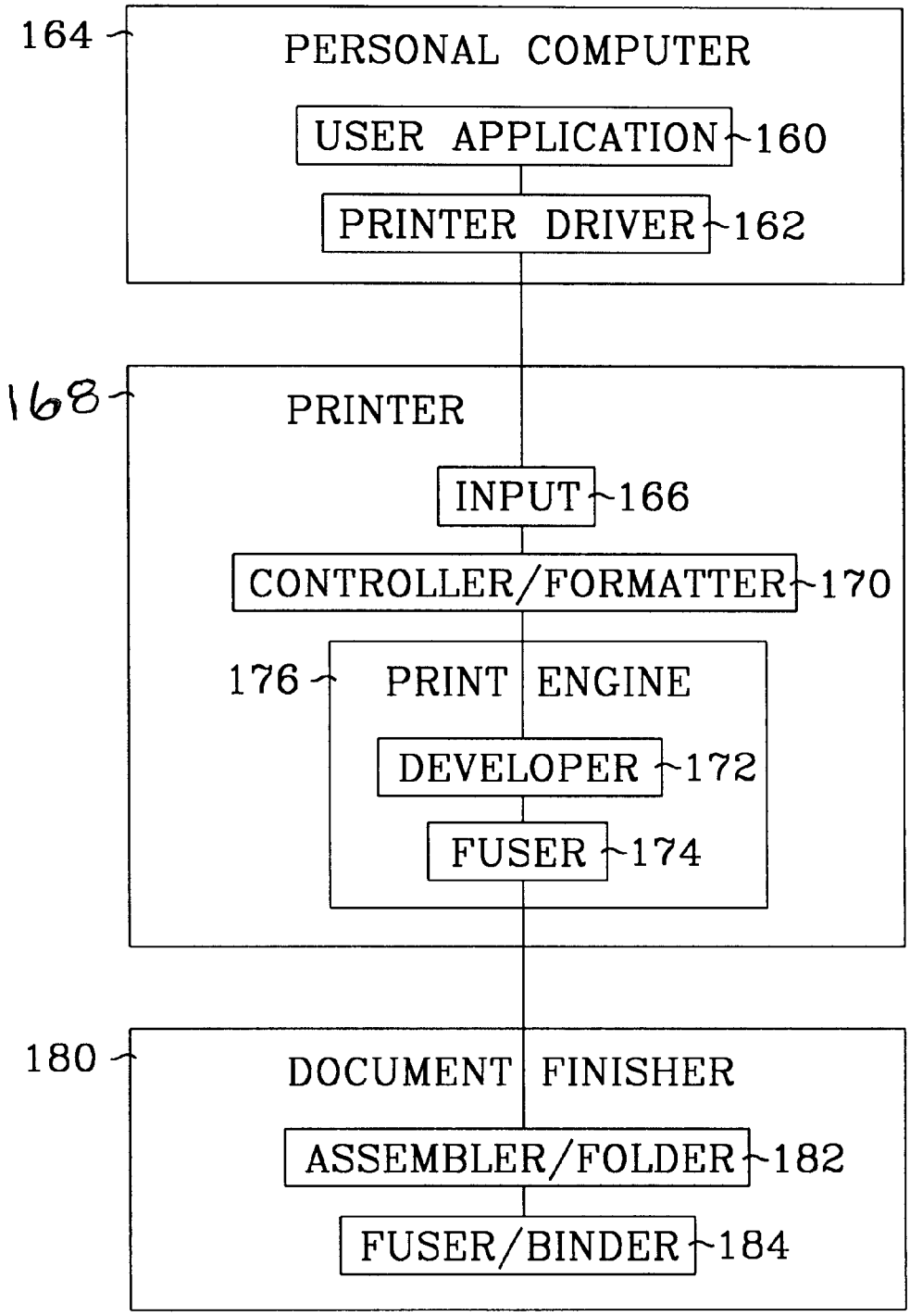
FIG. 8 is a block diagram showing a device for printing and binding documents according to one embodiment of the invention.

One device for printing and binding a document according to the present invention is illustrated in the block diagram of FIG. 8. Although it is expected that the binding techniques of the present invention will be most often used with and embodied in electrophotographic printing devices such as the laser printer illustrated in FIG. 8, these techniques could be used with and embodied in various other types of image forming devices. Referring now to FIG. 8, document generating application software 160 and printer driver 162 on a personal computer 164, or some other input device, transmit data representing the desired print image to input 166 on laser printer 168. The binding region on which imaging material will be applied to bind sheets together may be selected by document generating software 160 and sent on to the printer along with or as part of the print image data. Alternatively, the binding region may be selected by printer driver 162, a stand alone document processing and finishing software, or by formatter 170. The data is analyzed in the printer's controller/formatter 170, which typically consists of a microprocessor and related programmable memory and page buffer. Controller/formatter 170 formulates and stores an electronic representation of each page that is to be printed, including the print image and the binding region. In addition to formatting the data received from input 166, controller/formatter 170 drives and controls the toner development unit 172, fuser 174 and other components of print engine 176.

In a laser printer, the toner developer 172 typically includes a scanning laser beam, a rotating photoconductive drum, a charging roller, a developing roller and a transfer roller. The charging roller charges the photoconductive drum to a relatively high substantially uniform negative polarity at its surface. The areas on the fully charged drum exposed to the scanning laser beam represent the desired image. The areas of the drum exposed to the laser beam are partially or fully discharged, depending on the intensity of the light beam and the duration of exposure. The unexposed background areas of the drum remain fully charged. This process creates a latent electrostatic image on the photoconductive drum. The developing roller transfers toner onto the drum to form a toner image on the drum. The toner is transferred from the photoconductive drum onto paper or other print media as the paper passes between the drum and the transfer roller. The toner is then fused to the paper as the paper passes between the heated fusing rollers in fuser 174.

Once the print image and the binding toner is fused, the paper passes to a document finisher 180. Document finisher 180 includes an assemling device 182 and a second fuser 184. The now printed sheets of paper are stacked or otherwise assembled for binding in assembling device 182 and then the toner is re-fused to bind the sheets. It is expected that assembling device 182 and fuser 184 will often be integrated into a single device configured to perform both functions.

While a laser printer is described, it is also possible to use a different kind of printer such as an ink jet printer. In the case of the ink jet printer, it would be advantageous to separately apply the toner used as the binding material, as this would eliminate the need to provide ink jet toner which can be re-activated. An advantage of using a different type of imaging ink is that the different type of imaging ink can be formulated so as not to re-activate when energy is applied.

It is possible to apply the binding material separately from the application of the primary image on the sheet media. This allows the use of a source of binding material which is different from imaging toner used for the primary image, and allows the binding material to be applied in "full bleed." This also permits the use of the binding material in equipment which may be separate or separable from a printer. By applying the binding material separately, it is also possible to use a mixed system of toner types such as inkjet toner for a primary image and energy activated bonding material, and activate or reactivate the toner for binding purposes without substantially affecting the primary image. Alternatively, the process can be implemented such that the imaging and bonding material are printed and fused, thereafter the patterned areas of the sheet print media are held in contact with each other for bonding, and the heat is reapplied selectively to those areas for bonding.

Fusing of the electrophotographic toner material, as is well known in the art, is done with heat and pressure in a variety of implementations. It may be advantageous in one implementation to merely "fix" the toner in place by the printer development system, and later "fuse" both the imaged and bonding regions at the same time. Alternatively, the imaged region and binding regions can be fused at the same time, and then subsequently re-fixed or re-fused in the binding regions and thereby re-activate the toner in the binding regions to bind the sheets together. Hence, "activate" and "re-activate" are to be construed broadly to include the variety of implementations in which the toner or other imaging material is fixed or fused or otherwise caused to adhere to itself and/or to the print media.

As can be seen, a variety of configurations may be used in order to accomplish binding according to the present invention. The above embodiments are given only by way of example. For example, it is also possible to combine the folding process used to create booklets such as shown in FIG. 1 with the re-activation process, thereby eliminating one step in paper handling. Accordingly, the invention should be read as limited only by the appended claims.

What is claimed is:

1. A method of binding sheet media, comprising:

applying imaging material in a pattern of a desired print image on each sheet;

applying imaging material to a binding region on each sheet, the binding region aligned with and facing a binding region on an adjacent sheet when the sheets are assembled for binding;

activating the imaging material in the print pattern and in the binding region;

assembling the sheets for binding; and re-activating the imaging material in the binding regions to bind the sheets.

2. The method of claim 1, wherein the imaging material is toner and the steps of activating and re-activating the imaging material comprise fusing and re-fusing the toner.

3. The method of claim 1, wherein the imaging material is applied to the same thickness in the print pattern and in the binding region.

4. The method of claim 1, wherein the imaging material for printing and the imaging material for binding are applied from a common source and the step of applying imaging material to a binding region is performed substantially contemporaneously with the step of applying imaging material in a print pattern.

5. The method of claim 1, wherein the imaging material for printing and the imaging material for binding are applied at least partially from different sources and the step of applying imaging material to a binding region and the step of applying imaging material in a print pattern are performed sequentially.

6. A method of sealing a printed document, comprising:

providing first and second sheets;

applying imaging material in a pattern of a desired print image on the first sheet;

applying imaging material to a binding region on at least one of the sheets, the binding region surrounding the print image when the sheets are assembled for binding;

activating the imaging material;

arranging the first and second sheets for binding; and re-activating the imaging material in the binding region to bind the arranged sheets and form a sealed perimeter around the print image.

7. The method of claim 6, wherein the sheets are discrete from one another and the step of applying imaging material to a binding region on at least one of the sheets comprises applying imaging material to a binding region on the first sheet.

8. The method of claim 6, wherein the sheets are discrete from one another and the step of applying imaging material to a binding region on at least one of the sheets comprises applying imaging material to a binding region on the second sheet facing the print image on the first sheet when the sheets are arranged for binding.

9. The method of claim 6, wherein the sheets are portions of a single page of sheet media.

10. The method of claim 6, wherein the step of applying imaging material to a binding region on at least one of the sheets comprises applying imaging material to a binding region on each sheet aligned with and facing the binding region on the other sheet when the sheets are arranged for printing.

11. A method for printing and binding a booklet in which each sheet of paper or other print media is folded and bound along a line so that sides of each sheet on opposing sides of the folding line form the pages of the booklet, the method comprising:

applying imaging material to the sheets in a pattern of desired print images on pages formed on the sides of each sheet opposite the fold line;

applying imaging material to a binding region along the fold line of each sheet;

activating the imaging material;

assembling two or more sheets for binding along the fold line; and re-activating imaging material in the binding region to bind the assembled sheets.

12. The method of claim 11, wherein the step of applying imaging material to a binding region comprises applying imaging material to a binding region aligned with and facing a binding region on an adjacent sheet when the sheets are assembled for binding.

13. The method of claim 11, wherein the step of applying imaging material to a binding region comprises applying imaging material continuously along the fold line of each sheet.

14. The method of claim 11, wherein the step of applying imaging material to a binding region comprises applying imaging material as a series of discrete spots along the fold line of each sheet.

15. A method of binding sheet media, comprising:

applying imaging material in a pattern of a desired print image on at least one sheet;

designing a binding pattern sized and shaped to fit in a corner of a sheet, the binding pattern having rounded corners to spread binding stresses;

applying imaging material in the binding pattern near one corner on the sheet;

activating the imaging material;

assembling two or more sheets for binding; and re-activating imaging material in the binding region to bind the assembled sheets.

16. A method of binding sheet media, comprising:

applying imaging material in a pattern of a desired print image on at least one sheet;

designing a binding pattern sized and shaped to fit in a corner of a sheet, the binding pattern having a pointed aspect to concentrate separation stresses;

applying imaging material in the binding pattern near one corner on the sheet;

activating the imaging material;

assembling two or more sheets for binding; and re-activating imaging material in the binding region to bind the assembled sheets.

17. A method of forming an enclosed document from a single sheet, comprising:

applying imaging material in a pattern of a desired print image on the sheet;

applying imaging material as a binder at select areas along the periphery of the sheet;

activating the imaging material;

folding the sheet into two or more sections; and re-activating the imaging material at the select areas of the periphery of the sheet.

18. A device for printing and binding a document using imaging material as the binder, the device comprising:

an applying device operative to apply imaging material in a pattern of a desired print image on each sheet in the document and to apply imaging material to a binding region on each sheet, the binding region aligned with and facing a binding region on an adjacent sheet when the sheets are assembled for binding;

a first activating device operatively coupled to the applying device, the first activating device operative to activate the imaging material in the print pattern and in the binding region; and a second activating device operatively coupled to the first activating device, the second activating device operative to re-activating the imaging material in the binding regions to bind the sheets.

19. The device of claim 18, wherein the applying device and the first activating device comprise a laser printer having a controller configured to format a digital representation of the desired print image and a digital representation of the binding region to which imaging material is applied, a toner development unit for applying imaging material and a toner fuser for activating the imaging material after it is applied to the print media.

20. The device of claim 19, wherein the second activating device comprises a second toner fuser operatively coupled to and disposed downstream from the first toner fuser.

21. A device for printing and binding a document using imaging material as the binder, the device comprising:

an applying device operative to apply imaging material in a pattern of a desired print image on each sheet in the document and to apply imaging material to a binding region on each sheet, the binding region surrounding the print image when the sheets are assembled for binding;

a first activating device operatively coupled to the applying device, the first activating device operative to activate the imaging material in the print pattern and in the binding region; and a second activating device operatively coupled to the first activating device, the second activating device operative to re-activating the imaging material in the binding regions to bind the sheets.

22. The device of claim 21, wherein the applying device and the first activating device comprise a laser printer having a controller configured to format a digital representation of the desired print image and a digital representation of the binding region to which imaging material is applied, a toner development unit for applying imaging material and a toner fuser for activating the imaging material after it is applied to the print media.

23. The device of claim 22, wherein the second activating device comprises a second toner fuser operatively coupled to and disposed downstream from the first toner fuser.

24. A device for printing and binding a booklet in which each sheet of print media is folded and bound along a line so that sides of each sheet on opposing sides of the folding line form the pages of the booklet, the device comprising:

an applying device operative to apply imaging material to the sheets in a pattern of a desired print image on pages formed on each sheet opposite the fold line and to apply imaging material to a binding region along the fold line of each sheet;

a first activating device operatively coupled to the applying device, the first activating device operative to activate the imaging material in the print pattern and in the binding region;

a folding device receiving sheets operatively coupled to the first activating device, the folder operative to fold the sheets along the fold line; and a second activating device operatively coupled to the folding device, the second activating device operative to re-activating the imaging material in the binding regions to bind the folded sheets.

* * * * *